US010935278B2

(12) United States Patent
Park et al.

(10) Patent No.: US 10,935,278 B2
(45) Date of Patent: Mar. 2, 2021

(54) TUBULAR HEAT EXCHANGER

(71) Applicant: KYUNGDONG NAVIEN CO., LTD., Pyeongtaek-si (KR)

(72) Inventors: Jun Kyu Park, Seoul (KR); Su Hyun Lee, Seoul (KR); Sung Jun Ahn, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 153 days.

(21) Appl. No.: 16/089,469

(22) PCT Filed: Mar. 15, 2017

(86) PCT No.: PCT/KR2017/002799
§ 371 (c)(1),
(2) Date: Sep. 28, 2018

(87) PCT Pub. No.: WO2017/171276
PCT Pub. Date: Oct. 5, 2017

(65) Prior Publication Data

US 2019/0101307 A1 Apr. 4, 2019

(30) Foreign Application Priority Data

Mar. 28, 2016 (KR) ..... 10-2016-0036878

(51) Int. Cl.
*F28F 13/06* (2006.01)
*F24H 1/36* (2006.01)
(Continued)

(52) U.S. Cl.
CPC ..... *F24H 1/36* (2013.01); *F15D 1/00* (2013.01); *F24H 1/34* (2013.01); *F24H 1/40* (2013.01);
(Continued)

(58) Field of Classification Search
CPC ... F28F 3/027; F28F 13/06; F24H 8/00; F22B 37/06; F22B 1/02; Y02B 30/102
See application file for complete search history.

(56) References Cited

U.S. PATENT DOCUMENTS 1,540,535 A * 6/1925 Burke ..... F24H 1/205 138/38
2,906,250 A * 9/1959 Clarkson ..... F24D 1/00 122/165
(Continued)

FOREIGN PATENT DOCUMENTS

CN 104884889 A 9/2015
EP 0271434 A2 6/1988
(Continued)

OTHER PUBLICATIONS

International Search Report of PCT/KR2017/002799, dated Jun. 15, 2017, English translation.

*Primary Examiner* — Gregory A Wilson
(74) *Attorney, Agent, or Firm* — STIP Law Group, LLC

(57) ABSTRACT

The objective of the present invention is to provide a tubular heat exchanger capable of improving heat exchange efficiency and preventing deformation and damage thereof even in a high water-pressure environment. To this end, the present invention includes an outer jacket through which a heat medium is introduced and discharged; a combustion chamber coupled to the inside of the outer jacket so that a heat medium passage is formed between the combustion chamber and the outer jacket, and configured to perform combustion of a burner; a plurality of tubes formed in a flat shape for allowing combustion gas, which is generated in the combustion chamber, to flow along the inside of the combustion chamber and exchange heat with the heat medium;
(Continued)

and a turbulator coupled to the inside of the tubes so as to induce generation of turbulence in a flow of the combustion gas.

18 Claims, 15 Drawing Sheets

(51) Int. Cl.

| | |
|---|---|
| ***F28D 7/10*** | (2006.01) |
| ***F24H 9/00*** | (2006.01) |
| ***F24H 1/34*** | (2006.01) |
| ***F15D 1/00*** | (2006.01) |
| ***F24H 1/40*** | (2006.01) |
| ***F28D 21/00*** | (2006.01) |
| ***F24H 1/44*** | (2006.01) |
| ***F28F 1/04*** | (2006.01) |
| ***F28F 13/12*** | (2006.01) |

(52) U.S. Cl.
CPC ..... *F24H 1/44* (2013.01); *F24H 9/00* (2013.01); *F24H 9/0015* (2013.01); *F24H 9/0026* (2013.01); *F28D 7/10* (2013.01); *F28D 21/00* (2013.01); *F28F 1/04* (2013.01); *F28F 13/12* (2013.01)

(56) References Cited

U.S. PATENT DOCUMENTS 3,235,003 A * 2/1966 Smith ..... F01N 1/125 165/135
3,607,132 A * 9/1971 Sudduth ..... B01D 53/523 422/171
4,577,681 A * 3/1986 Hughes ..... F28F 13/12 165/109.1
4,823,865 A * 4/1989 Hughes ..... F28F 13/12 138/38
6,044,803 A 4/2000 Hamos et al.
7,267,163 B2 * 9/2007 Osakabe ..... F28F 3/027 165/153
8,720,387 B2 * 5/2014 Pacholski ..... F24H 8/00 122/15.1
8,783,334 B2 * 7/2014 Lovato ..... F24H 1/287 165/146
8,813,688 B2 * 8/2014 Pacholski ..... F24H 1/287 122/15.1
2011/0247793 A1 * 10/2011 Schoubye ..... F28F 21/006 165/177

FOREIGN PATENT DOCUMENTS

| | | | | | |
|---|---|---|---|---|---|
| EP | 2437022 | A2 | | 4/2012 | |
| EP | 2508834 | A2 | | 10/2012 | |
| EP | 2940417 | A1 | | 11/2015 | |
| EP | 3511665 | A1 | * | 7/2019 | ..... F28D 7/16 |
| JP | H0311267 | A | | 1/1991 | |
| JP | 03140795 | A | | 3/1993 | |
| JP | 05052565 | U | | 3/1993 | |
| JP | H0552565 | U | | 7/1993 | |
| JP | 2003214778 | A | | 7/2003 | |
| JP | 2011106782 | A | | 6/2011 | |
| KR | 1020090063438 | A | | 6/2009 | |
| KR | 101400833 | B1 | | 5/2014 | |
| KR | 1020140054726 | A | | 5/2014 | |
| WO | WO2009078577 | A1 | | 6/2009 | |
| WO | WO2014142688 | A1 | | 9/2014 | |
| WO | WO-2017171276 | A1 | * | 10/2017 | ..... F24H 1/34 |

* cited by examiner

【FIG. 1】
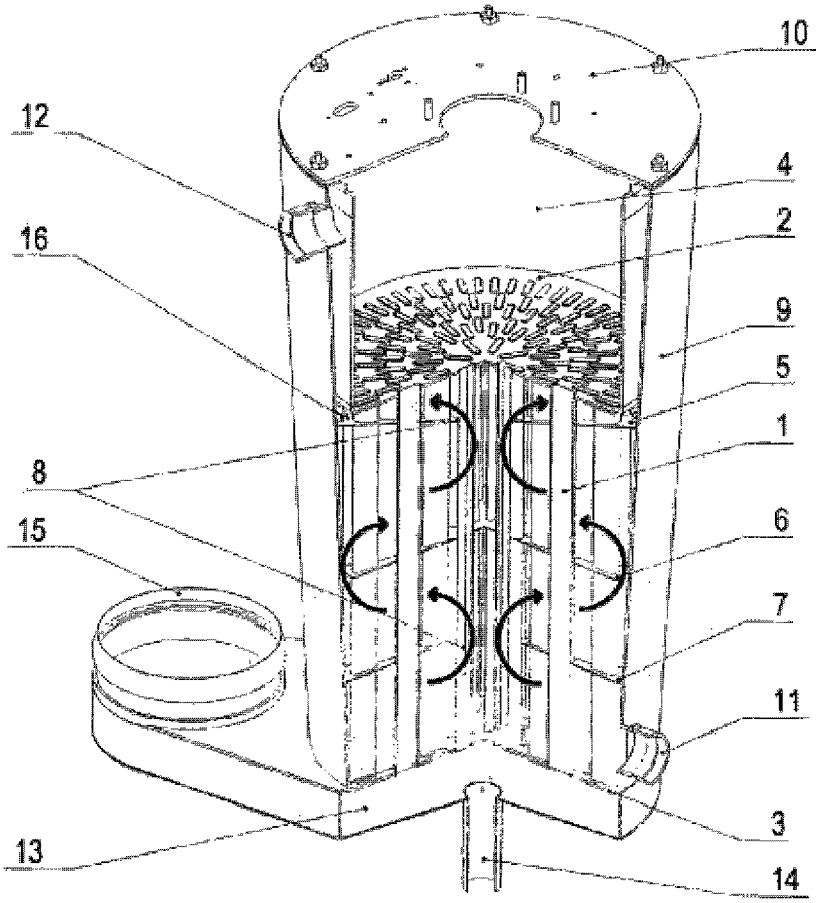
PRIOR ART

【FIG. 2】
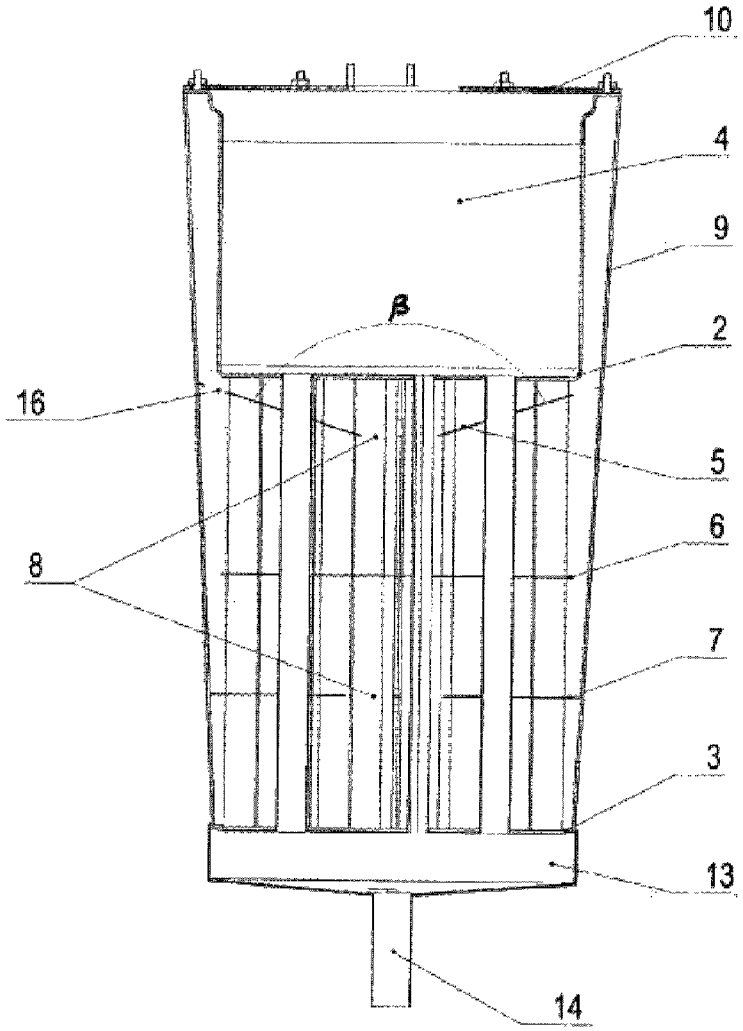
PRIOR ART

【FIG. 3】
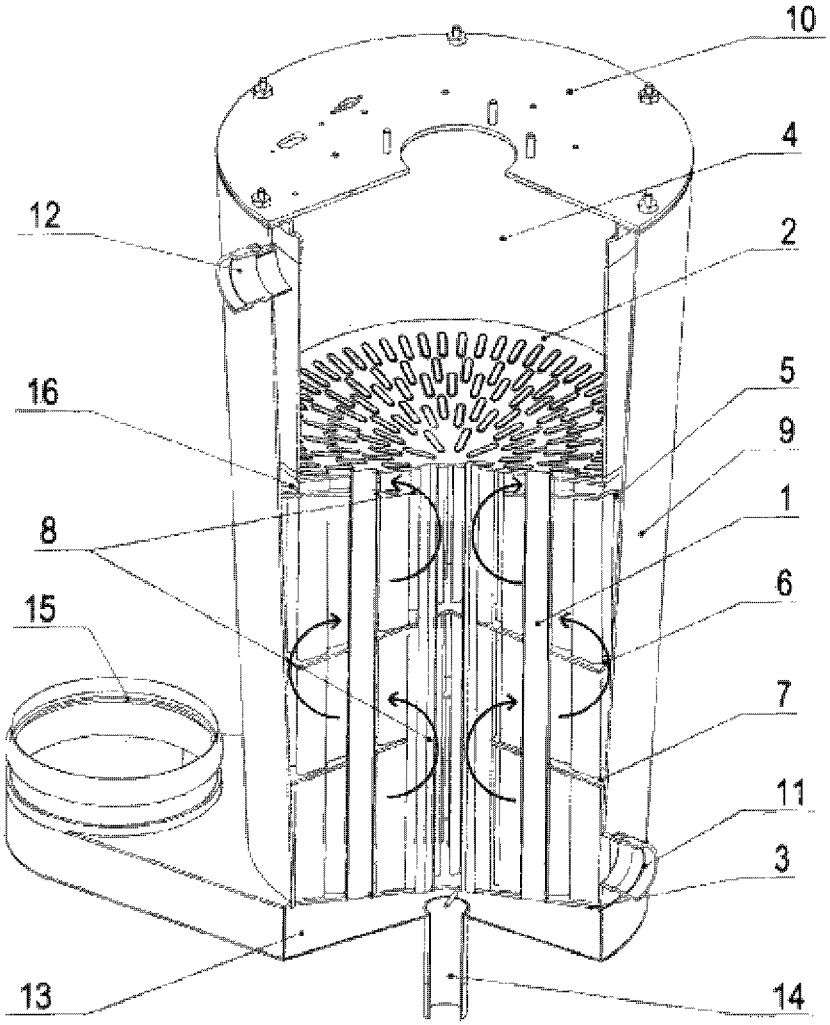
PRIOR ART

【FIG. 4】
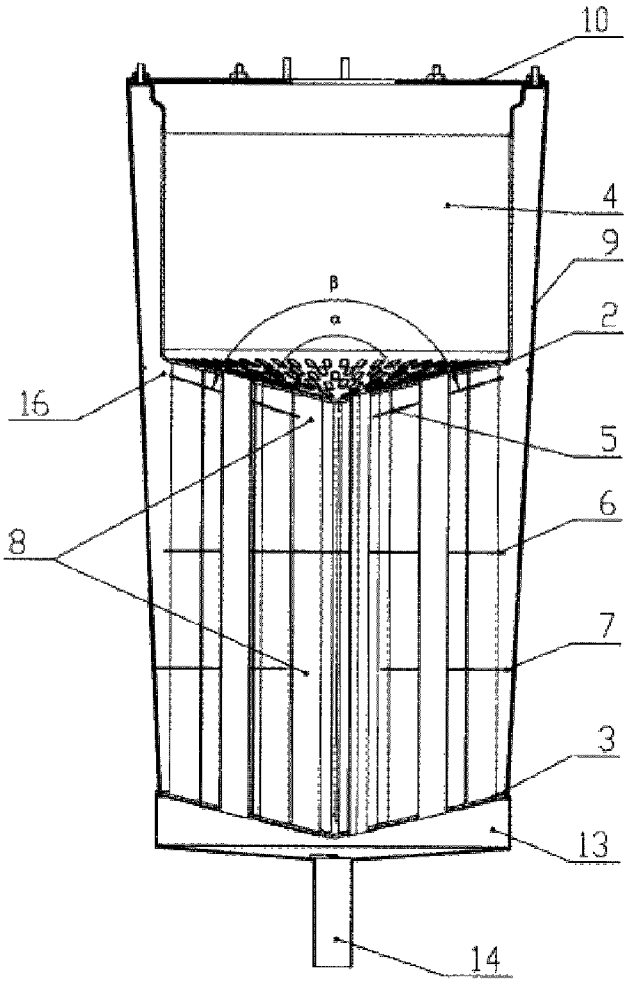
PRIOR ART

【FIG. 5】
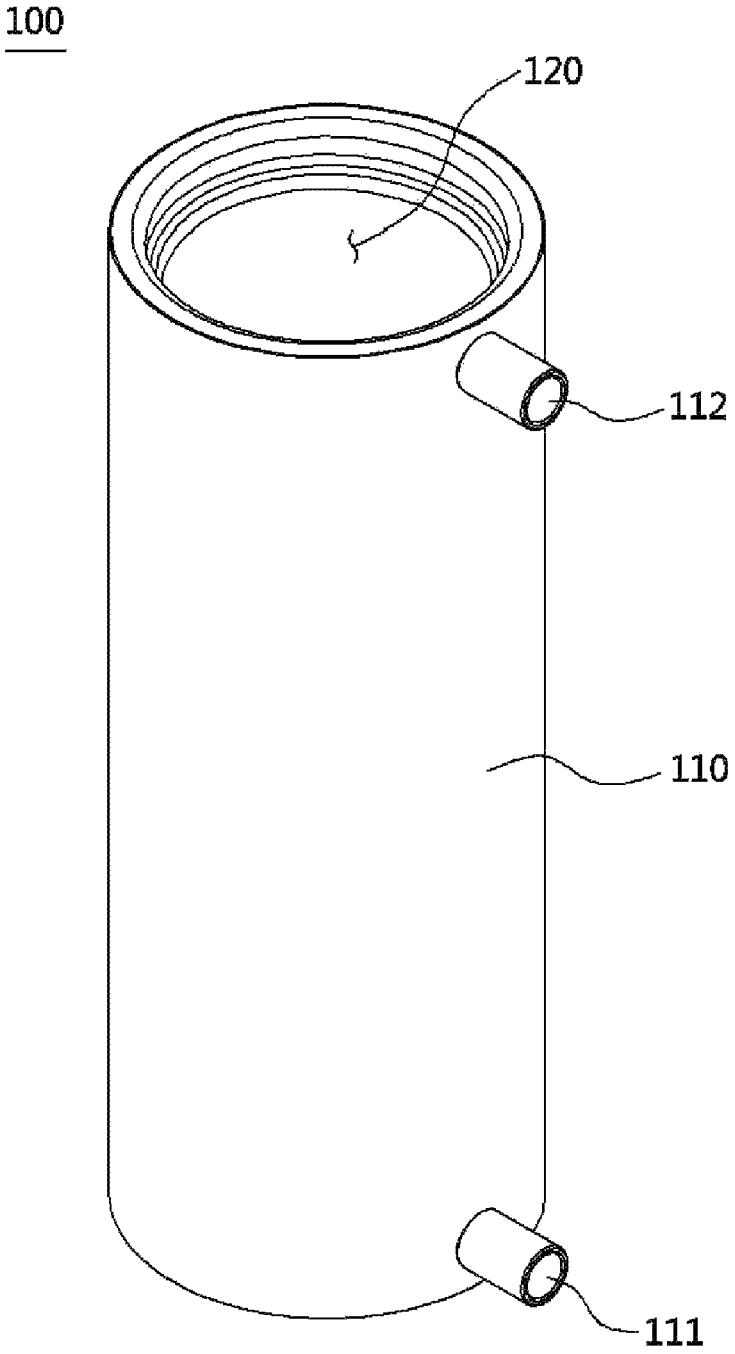

【FIG. 6】
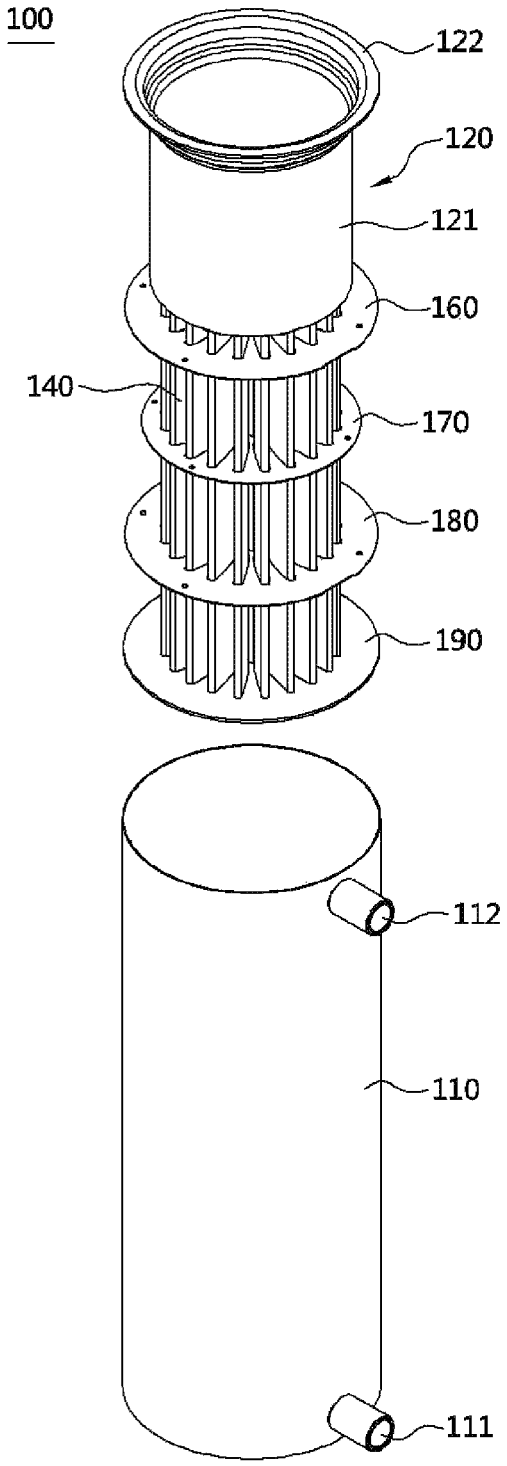

【FIG. 7】
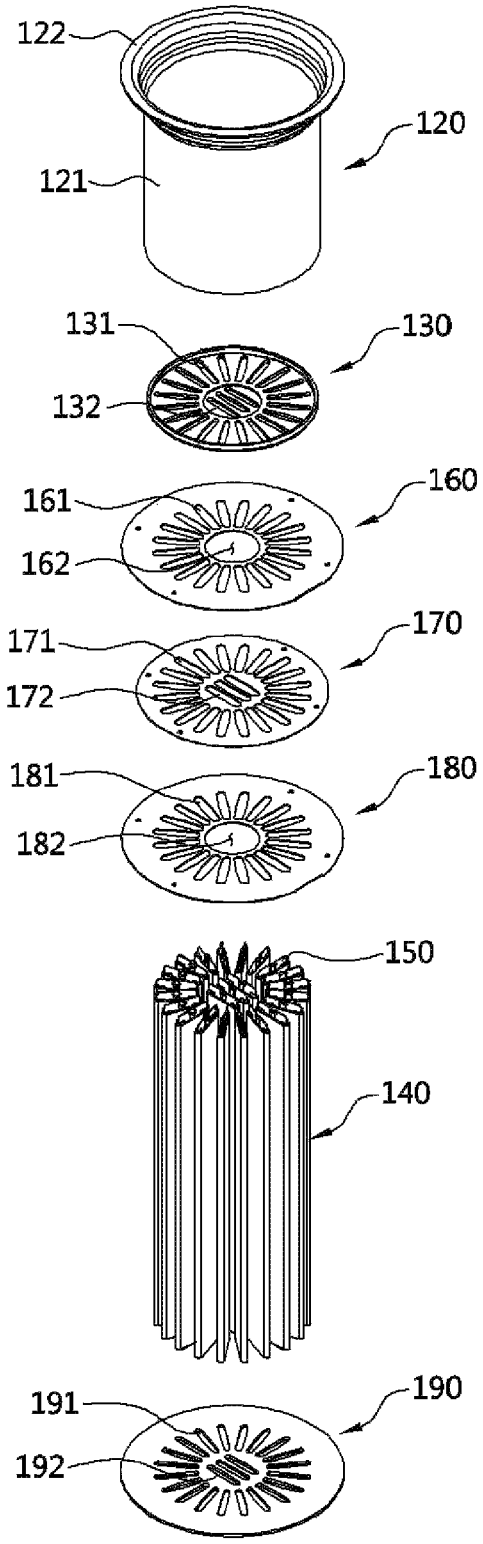

【FIG. 8】
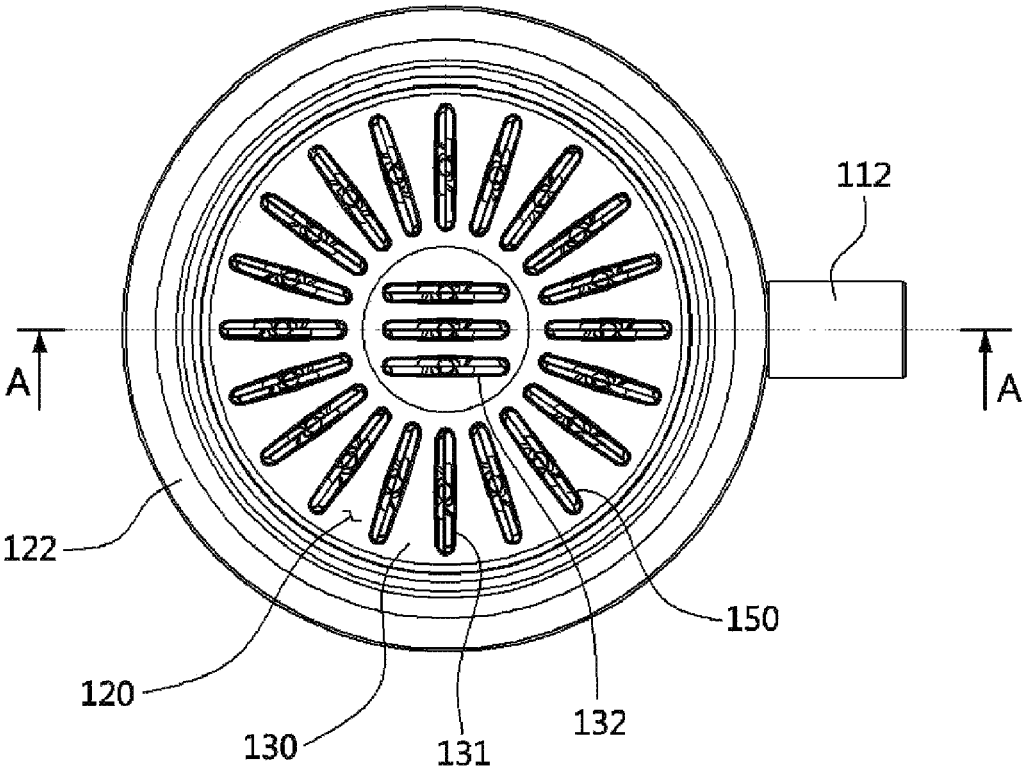

【FIG. 9】
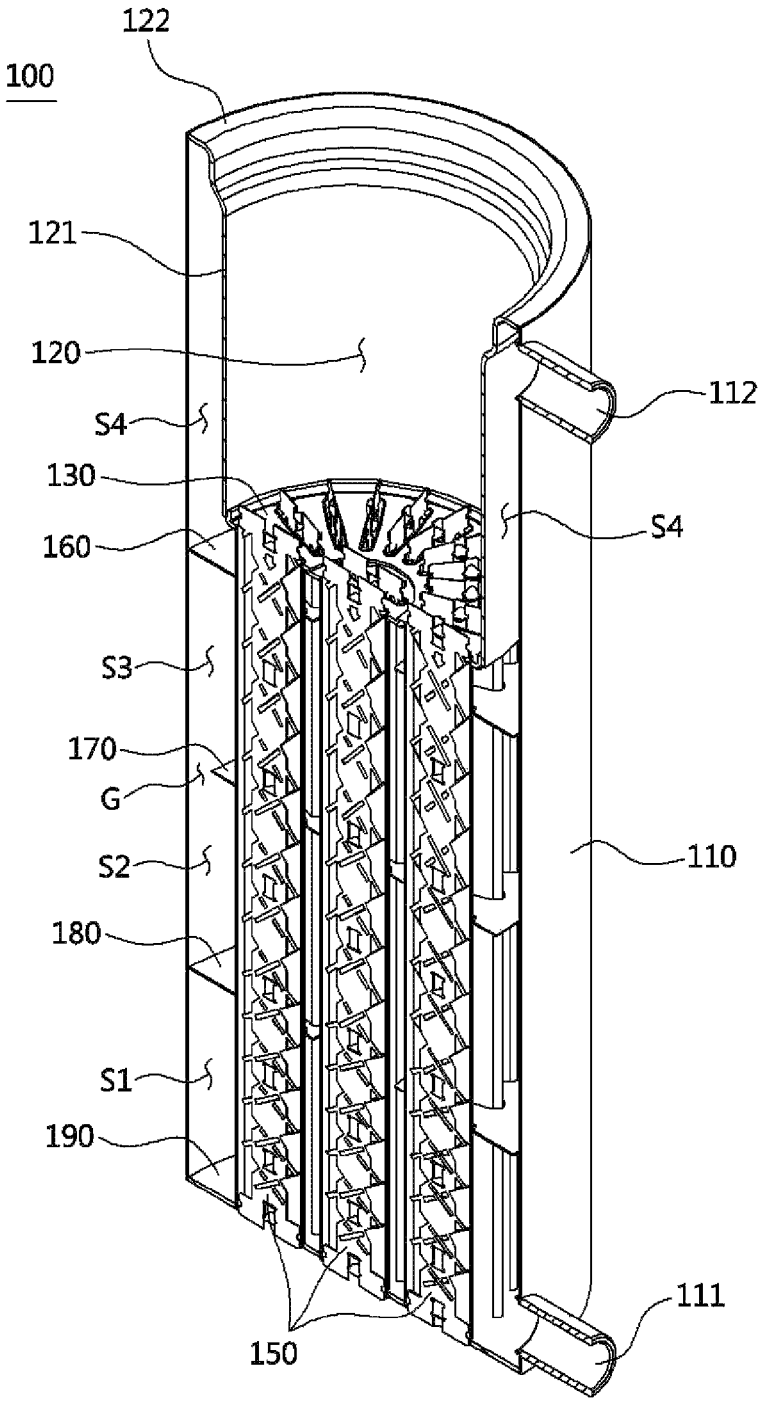

【FIG. 10】
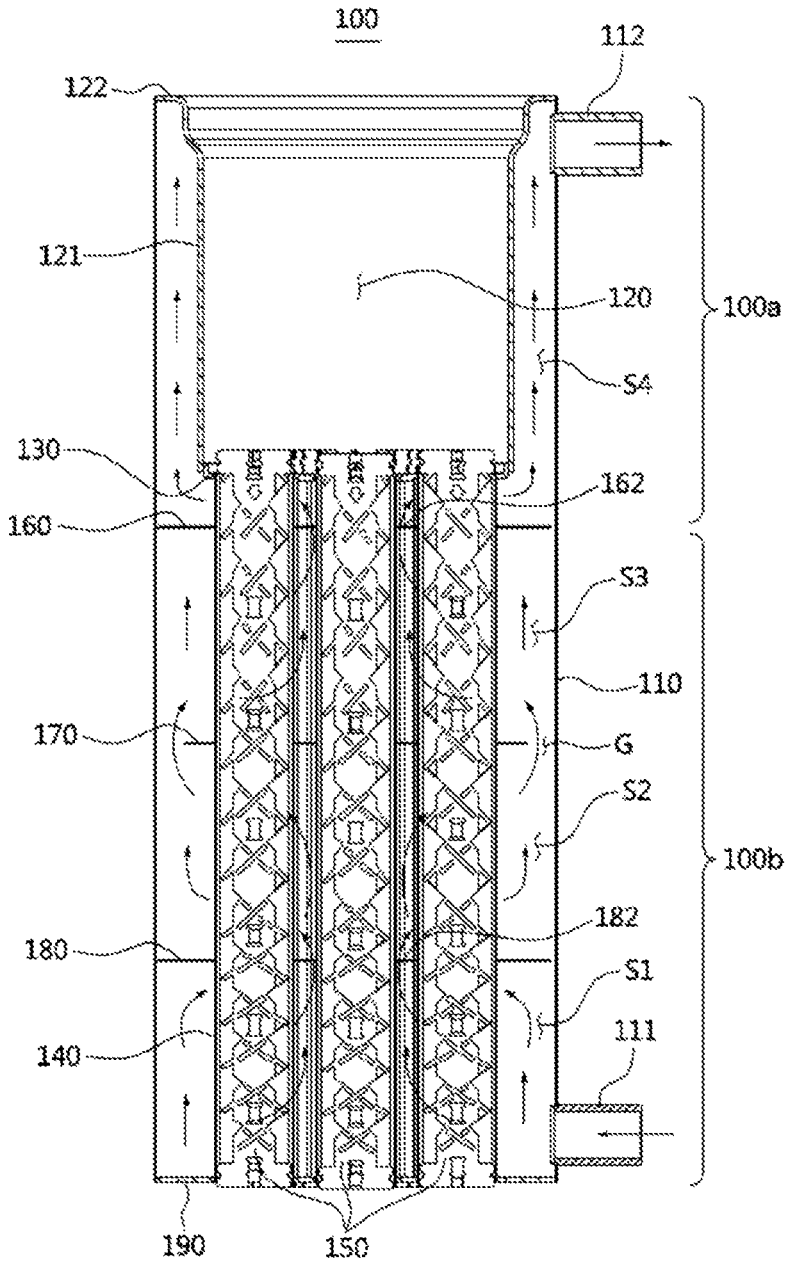

【FIG. 11A】
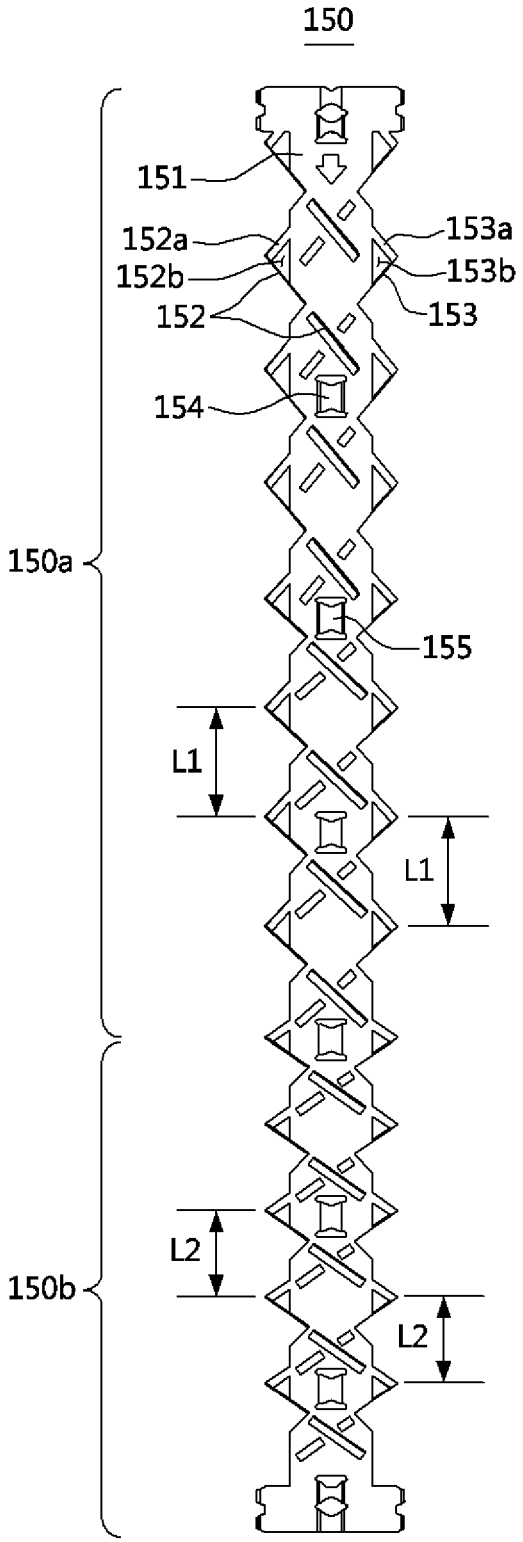

【FIG. 11B】
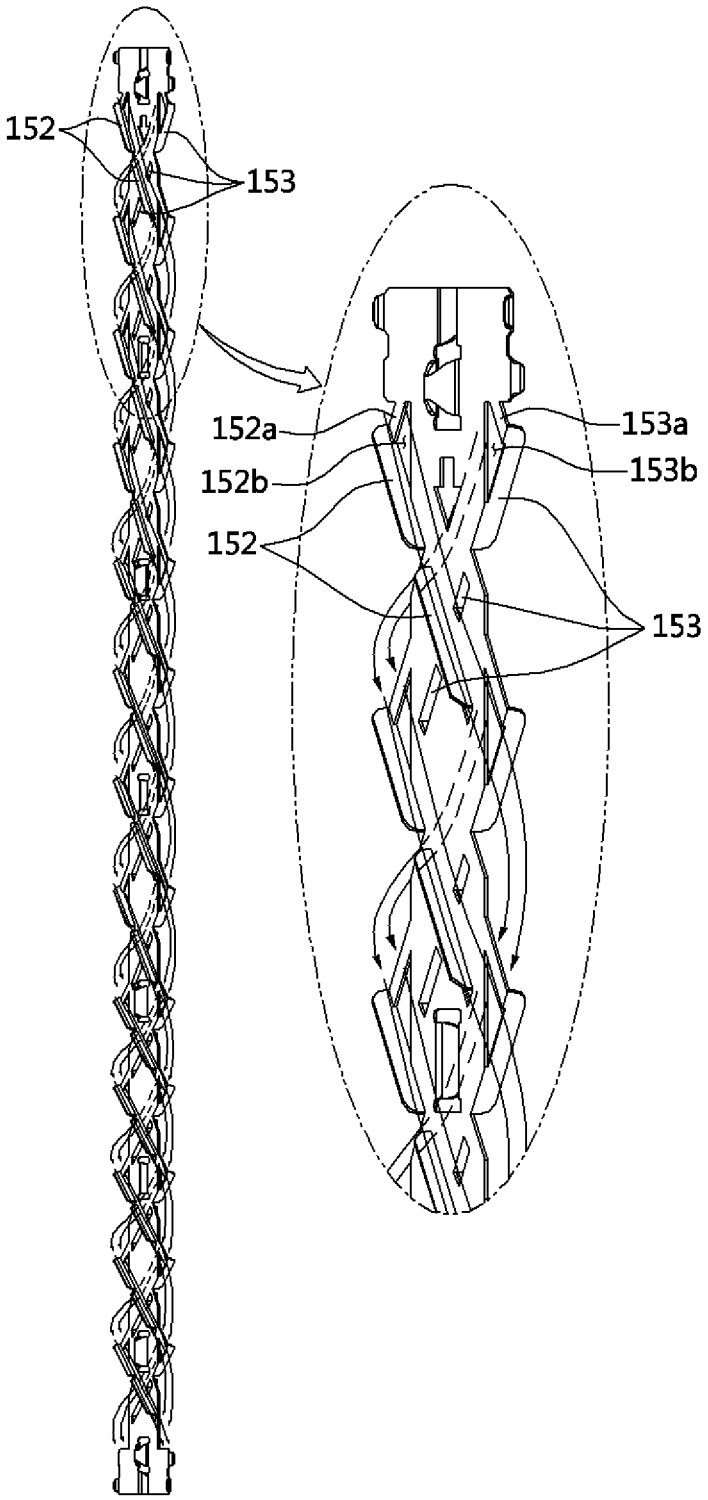

【FIG. 12】
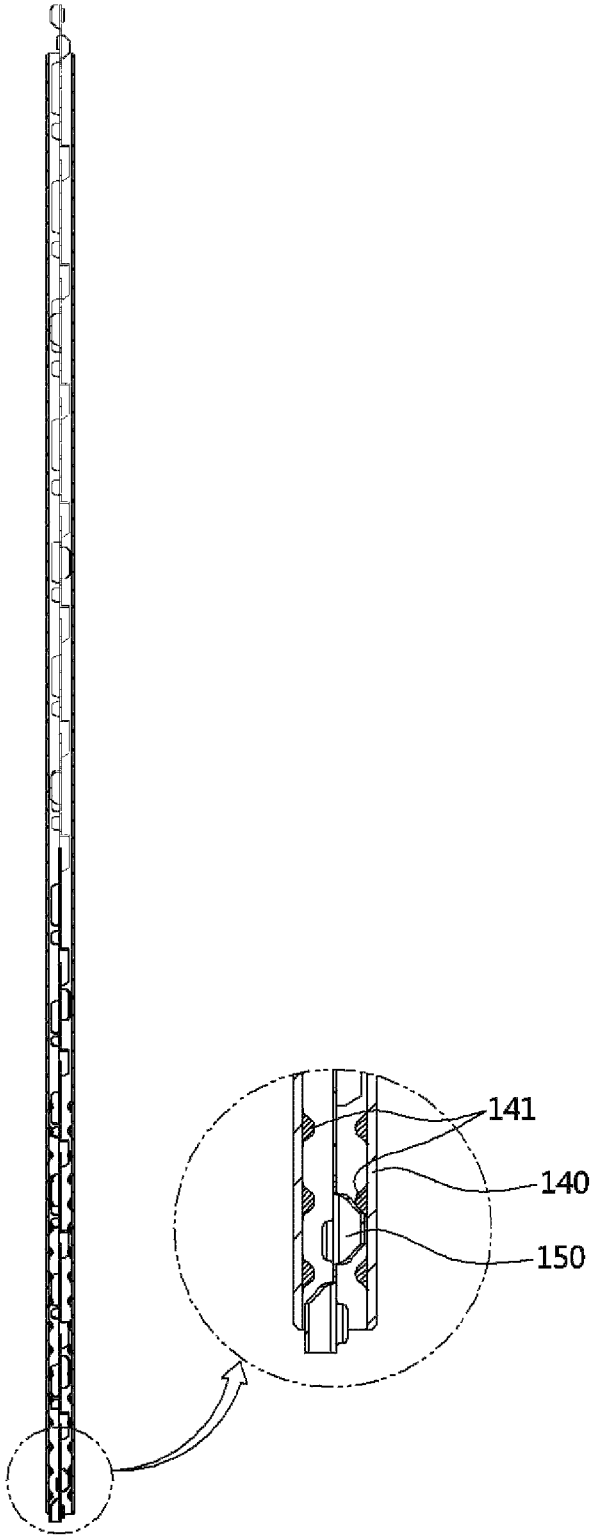

【FIG. 13A】
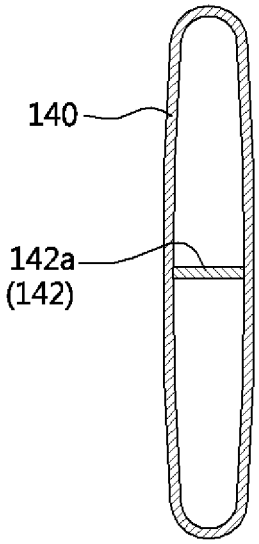
【FIG. 13B】
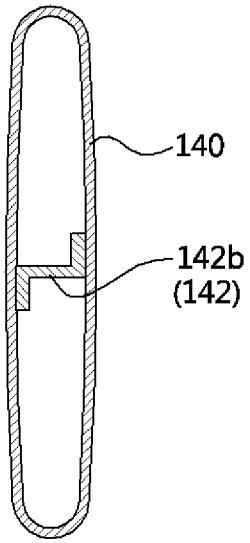

【FIG. 13C】
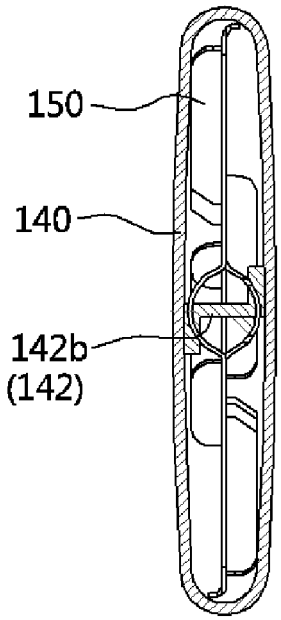
【FIG. 13D】
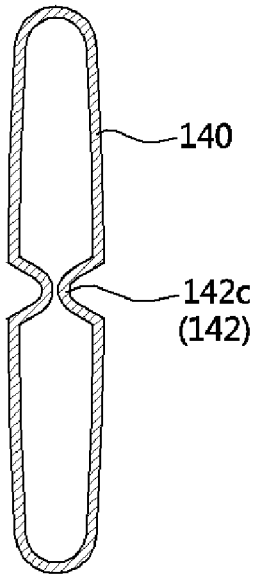

TUBULAR HEAT EXCHANGER

CROSS-REFERENCE TO RELATED APPLICATIONS

This application is the U.S. National Phase under 35 U.S.C. § 371 of International Application No. PCT/KR2017/002799 filed on Mar. 15, 2017, which in turn claims the benefit of Korean Application No. 10-2016-0036878, filed on Mar. 28, 2016, the disclosures of which are incorporated by reference into the present application.

TECHNICAL FIELD

The present invention relates to a tubular heat exchanger, and more specifically, to a tubular heat exchanger configured to improve heat exchange efficiency, and prevent deformation and damage thereof even in a high water-pressure environment.

BACKGROUND ART

Generally, a heater includes a heat exchanger in which heat exchange between combustion gas and a heat medium is performed by combustion of fuel to perform heating or supply hot water using the heated heat medium.

Among heat exchangers, a tubular heat exchanger includes a plurality of tubes in which the combustion gas generated by combustion of a burner flows, and has a structure in which the heat exchange between the combustion gas and the heat medium is performed at the outside of the tubes by flowing the heat medium.

As a prior art related to the above-described tubular heat exchanger, FIGS. 1 and 2 illustrate a heat exchanger disclosed in European Laid-Open Patent No. EP 2508834, and FIGS. 3 and 4 illustrate a heat exchanger disclosed in European Laid-Open Patent No. EP2437022.

In the case of the heat exchanger shown in FIGS. 1 and 2, an outer jacket has a conical shape in a downward direction on the basis of an upper cover 10, and includes a combustion chamber 4, an upper plate 2, a plurality of flues under the upper plate, and a lower plate 3 under the flues therein. Three kinds of partitions 5, 6, and 7 are installed between the upper plate 2 and the lower plate 3, and the upper partition 5 is formed in a conical shape at an angle greater than 90° and smaller than 180°, and has an opening at a center thereof. The middle partition 6 is formed in a flat shape having a diameter smaller than or similar to a diameter of an outer pipe, and the lower partition 7 has a structure having a diameter similar to that of the outer pipe and having an opening at a center thereof. Regular distribution holes are added in the partition, and have a structure arranged according to the number of singular circles or concentric circles.

The combustion gas generated by the combustion of the burner engaged with the upper cover 10 undergoes primary heat exchange in the combustion chamber 4, and sensible heat and latent heat of the combustion gas are transferred to a fluid in the heat exchanger through the plurality of flues. The fluid in the heat exchanger is introduced through a fluid inlet 11 and flows to the outside of the diameter of the middle partition 6 through the center opening of the lower partition 7, and then flows to the center opening of the upper partition 5 to be discharged to a fluid outlet 12.

The heat exchanger shown in FIGS. 3 and 4 has a structure similar to the structure shown in FIGS. 1 and 2, but has a structure in which each of the upper plate 2 and the lower plate 3 is formed in a conical shape.

Each of the flues formed in a flat shape having an embossing portion applied thereto which is applied to the conventional heat exchanger shown in FIGS. 1 to 4 can be applied to a low pressure boiler, but cannot be applied to apparatuses used in a high-pressure environment such as water heater, commercial products, and a high capacity boiler due to high probability of deformation and damage of the flues. To this end, the thickness of an applied material should be increased, and accordingly, costs for the material sharply increase.

Further, since an upper part of each of the flues which is a path through which high temperature combustion gas having a large volume per unit mass flows, and a lower part of each of the flues through which the combustion gas having a low temperature after being heat-exchanged has the same flue structure, when an applied quantity of embossing portions is increased to improve heat exchange efficiency, a flow resistance is greatly increased at the upper part of each of the flues, and when the applied quantity of embossing portions is decreased to solve the greatly increased flow resistance described above, heat exchange efficiency of the latent heat part from which a condensing effect occurs sharply decreases.

In a method of increasing the quantity of embossing portions in the latent heat part, a quantity greater than or equal to a predetermined quantity cannot be manufactured due to a shape and size of each embossing portion, and a manufacturing process becomes complicated and manufacturing costs increase even when the method is applied.

In the case of an inner partition, shapes of the three kinds are different due to a conical outer pipe, and thus the number of components increase, and particularly, since the upper partition is formed in a conical shape, processing costs increase, and a process of assembling the heat exchanger is complicated.

INVENTION

Technical Problem

The present invention is directed to providing a tubular heat exchanger capable of improving heat exchange efficiency, and preventing deformation and damage thereof even in a high water-pressure environment.

Technical Solution

The present invention provides a tubular heat exchanger (100) including an outer jacket (110) through which a heat medium is introduced and discharged; a combustion chamber (120) coupled to the inside of the outer jacket (110) so that a heat medium passage is formed between the combustion chamber (120) and the outer jacket (110), and configured to perform combustion of a burner; a plurality of tubes (140) formed in a flat shape for allowing combustion gas, which is generated in the combustion chamber (120), to flow along the inside of the combustion chamber (120) and exchange heat with the heat medium; and a turbulator (150) coupled to the inside of the tubes (140) to induce generation of turbulence in a flow of the combustion gas.

The plurality of tubes (140) may be installed in a vertical direction so that the combustion gas generated in the combustion chamber (120) may flow in a downward direction, and may be spaced apart in a circumferential direction and radially disposed.

A plurality of tubes (140) may be additionally disposed at a center between the plurality of tubes (140) which are radially disposed.

Multiple-stage partitions (160, 170, and 180) configured to guide a flow of the heat medium may be provided in the outer jacket (110) to be vertically spaced apart from each other so that a flowing direction of the heat medium may be alternatively changed between the inside and the outside of a circumferential direction.

The plurality of tubes (140) may be inserted into the multiple-stage partitions (160, 170, and 180) to be supported.

The multiple-stage partitions (160, 170, and 180) may include an upper partition (160), a middle partition (170), and a lower partition (180) each having a plate shape, wherein each of the upper partition (160) and the lower partition (180) may have an opening for the flow of the heat medium at a center thereof, and an edge portion provided to be in contact with an inner side surface of the outer jacket (110), and the middle partition (170) may be formed in a shape of which a center is blocked, and may have an edge portion provided to be spaced apart from the inner side surface of the outer jacket (110) so that the heat medium may flow therebetween.

An upper tube sheet (130) into which upper end portions of the plurality of tubes (140) are inserted may be coupled to a lower end of the combustion chamber (120), and a lower tube sheet (190) into which lower end portions of the plurality of tubes (140) are inserted may be coupled to a lower end of the outer jacket (110).

The turbulator (150) may include a flat part (151) configured to divide an inner space of the tube (140) into two portions and disposed in a longitudinal direction of the tube (140), and a plurality of first guide portions (152) and second guide portions (153) spaced apart from both side surfaces of the flat part (151) along a longitudinal direction and formed to alternatively protrude to be inclined.

The turbulator (150) may include an upper turbulator (150*a*) provided at a side into which the combustion gas is introduced, and a lower turbulator (150*b*) provided at a side from which the combustion gas is discharged, and an interval (L2) in which the plurality of first guide portions (152) and the plurality of second guide portions (153) formed in the lower turbulator (150*b*) are vertically spaced apart from each other may be disposed at a relatively denser interval than an interval (L1) in which the plurality of first guide portions (152) and the plurality of second guide portions (153) formed in the upper turbulator (150*a*) are vertically spaced apart from each other.

The first guide portion (152) may be disposed on one side surface of the flat part (151) to be inclined to one side, the second guide portion (153) may be disposed on the other side surface of the flat part (151) to be inclined to the other side, and each of the heat media introduced into the first guide portion (152) and the second guide portion (153) may be sequentially transferred to the second guide portion (153) and the first guide portion (152) disposed adjacent to an opposite side of the flat part (151) to alternatively flow through both spaces of the flat part (151).

A heat medium introduction end of the first guide portion (152) may be connected to one side end of the flat part (151) through a first connection portion (152*a*), and a first communication port (152*b*) in which fluid communication is performed through both spaces of the flat part (151) may be provided between the one side end of the flat part (151), the first connection portion (152*a*), and the first guide portion (152), a heat medium introduction end of the second guide portion (153) may be connected to the other side end of the flat part (151) through a second connection portion (153*a*), and a second communication port (153*b*) in which fluid communication is performed through both spaces of the flat part (151) may be provided between the other side end of the flat part (151), the second connection portion (153*a*), and the second guide portion (153).

The first guide portion (152) and the second guide portion (153) may include parts of the flat part (151) cut to be bent to both sides of the flat part (151), and fluid communication may be performed through both spaces of the flat part (151) through a cut part of each of the first guide portion (152) and the second guide portion (153).

The turbulator (150) may include an upper turbulator (150*a*) provided at a side into which the combustion gas is introduced, and a lower turbulator (150*b*) provided at a side from which the combustion gas is discharged, and an area of a path between the lower turbulator (150*b*) and an inner side surface of the tube (140) may be formed to be smaller than an area of a path between the upper turbulator (150*a*) and the inner side surface of the tube (140).

The lower turbulator (150*b*) may be formed to have an occupying area in the tube (140) greater than that of the upper turbulator (150*a*).

A plurality of protrusions (141) may be formed on the inner side surface of the tube (140) located at the side from which the combustion gas is discharged.

A supporter (142) configured to support water-pressure may be additionally provided in the tube (140).

The supporter (142) may include a support part of which both ends are fixed to an inner side surface of the tube (140).

The supporter (142) may include an embossing portion formed on each of both corresponding side surfaces of the tube (140) to protrude toward the inside of the tube (140).

The outer jacket (110) may be formed in a cylindrical shape.

Advantageous Effects

In a tubular heat exchanger according to the present invention, since a turbulator and a supporter are provided in a tube, and thus heat exchange efficiency can be improved and deformation and damage of the tube can be prevented even in a high water-pressure environment, the above can be applied to combustion apparatuses for various usage in addition to a boiler or a water heater.

Further, since an area of a path of combustion gas between a turbulator provided in a latent heat exchange part and the tube is provided to be smaller than an area of a path of the combustion gas between a turbulator provided in a sensible heat exchange part and the tube, and thus a flow resistance of combustion gas is reduced in the sensible heat exchange part into which the combustion gas is introduced and recovery efficiency of latent heat is improved in the latent heat exchange part, heat exchange efficiency can be improved.

In addition, since the sensible heat exchange part and the latent heat exchange part are formed in an integrated structure, a structure of the heat exchanger can be simplified and welding parts between components can be reduced, and since the tube is formed in a flat shape, a minimized high efficiency heat exchanger can be implemented.

In addition, since a flowing direction of a heat medium is changed by disposing multiple-stage partitions in a path of the heat medium, a flowing path of the heat medium can be elongated and heat exchange efficiency can be improved, and since a flowing speed of the heat medium is increased, partial overheating caused when the heat medium is congested, and boiling noise generation and heat efficiency degradation caused when foreign substances included in the heat medium are solidified and deposited due to the partial overheating can be prevented.

DESCRIPTION OF DRAWINGS

FIG. 1 is a cross-sectional perspective view illustrating an embodiment of a conventional tubular heat exchanger.

FIG. 2 is a cross-sectional view of FIG. 1.

FIG. 3 is a cross-sectional perspective view illustrating another embodiment of a conventional tubular heat exchanger.

FIG. 4 is a cross-sectional view of FIG. 3.

FIG. 5 is an exterior perspective view of a tubular heat exchanger according to the present invention.

FIGS. 6 and 7 are exploded perspective views of the tubular heat exchanger according to the present invention.

FIG. 8 is a plan view of FIG. 5.

FIG. 9 is a cross-sectional perspective view taken along line A-A of FIG. 8.

FIG. 10 is a cross-sectional view taken along line A-A of FIG. 8.

FIG. 11A is a front view of a turbulator.

FIG. 11B is a perspective views illustrating a flow of a combustion gas.

FIG. 12 is a cross-sectional view illustrating a shape of a tube at a discharge port of the combustion gas.

FIG. 13A, FIG. 13B, FIG. 13C and FIG. 13D are a cross-sectional view illustrating various embodiments of a support structure of the tube.

REFERENCE NUMERALS

| | |
|---|---|
| 100: heat exchanger | 100a: sensible heat exchange part |
| 100b: latent heat exchange part | 110: outer jacket |
| 111: heat medium introduction port | 112: heat medium discharge port |
| 120: combustion chamber | 121: combustion chamber body |
| 122: flange part | 130: upper tube sheet |
| 131, 132: tube insertion ports | 140: tube |
| 141: protrusion | 142: supporter |
| 150: turbulator | 150a: upper turbulator |
| 150b: lower turbulator | 151: flat part |
| 152: first guide portion | 152a: first connection portion |
| 152b: first communication port | 153: second guide portion |
| 153a: second connection portion | 153b: second communication port |
| 154, 155: welding parts | 160: upper partition |
| 161: tube insertion port | 162: opening |
| 170: middle partition | 171, 172: tube insertion ports |
| 180: lower partition | 181: tube insertion port |
| 182: opening | 190: lower tube sheet |
| 191, 192: tube insertion ports | |

Modes of the Invention

Hereinafter, a configuration and an action of a preferable embodiment of the present invention will be described below in detail with reference to the accompanying drawings.

Referring to FIGS. 5 to 10, a tubular heat exchanger 100 according to the present invention includes an outer jacket 110 through which a heat medium is introduced and discharged, a combustion chamber 120 coupled to the inside of the outer jacket 110 so that a heat medium passage is formed between the combustion chamber 120 and the outer jacket 110, and configured to perform combustion of a burner, a plurality of tubes 140 formed in a flat shape for allowing combustion gas, which is generated in the combustion chamber 120, to flow along the inside of the combustion chamber 120 and exchange heat with the heat medium, and a turbulator 150 coupled to the inside of the tubes 140 to induce generation of turbulence in the flow of the combustion gas.

Further, an upper tube sheet 130 into which upper end portions of the plurality of tubes 140 are inserted is coupled to a lower end of the combustion chamber 120, multiple-stage partitions 160, 170, and 180 configured to guide a flow of the heat medium are provided on an outer side surface of the tube 140 to be vertically spaced apart from each other so that a flowing direction of the heat medium is alternatively changed between the inside and the outside of a circumferential direction, and a lower tube sheet 190 into which lower end portions of the plurality of tubes 140 are inserted is coupled to a lower end of the outer jacket 110.

The plurality of tubes 140 may be installed in a vertical direction so that the combustion gas which is generated in the combustion chamber 120 flows in a downward direction and may be spaced apart in a circumferential direction and radially disposed, and a plurality of tubes 140 may be additionally disposed at a center between the plurality of tubes 140 which are radially disposed.

The outer jacket 110 is formed in a cylindrical shape of which an upper part and a lower part are open, a heat medium introduction port 111 is connected to one side of the lower part of the outer jacket 110, and a heat medium discharge port 112 is connected to one side of the upper part of the outer jacket 110. Since the outer jacket 110 is formed in the cylindrical shape, pressure-resistant performance may be improved.

The combustion chamber 120 includes a cylindrical combustion chamber body 121 of which an upper part and a lower part are open, and a flange part 122 formed on an upper end of the combustion chamber body 121 and seated on an upper end of the outer jacket 110. Since the combustion chamber body 121 is disposed to be spaced apart from an inner side surface of outer jacket 110 to the inside, a space S4 having a pipe structure through which the heat medium flow is provided between the combustion chamber body 121 and the outer jacket 110.

Referring to FIG. 7, the upper tube sheet 130 seals a lower part of the combustion chamber 120, and has a plurality of tube insertion ports 131 and 132 to which the upper end portions of the plurality of tubes 140 are insertion-coupled.

The multiple-stage partitions 160, 170, and 180 are vertically spaced apart from each other to be coupled to the outer surface of the tube 140 to change a path of the heat medium and support the tubes 140.

The multiple-stage partitions 160, 170, and 180 may include an upper partition 160, a middle partition 170, and a lower partition 180 each having a plate shape.

A tube insertion port 161 is radially formed in the upper partition 160, an opening 162 through which the tube 140 passes for the flow of the heat medium is formed at a center of the upper partition 160, and an edge portion of the upper partition 160 is provided to be in contact with the inner side surface of the outer jacket 110.

A plurality of tube insertion ports 171 and 172 are formed in the middle partition 170, and an area in which the tube insertion ports 171 and 172 are not formed is formed to be blocked, and an edge portion of the middle partition 170 is spaced apart from the inner side surface of the outer jacket 110 to have a flowing path of the heat medium in a space G therebetween.

Since the lower partition 180 has the same structure as the upper partition 160, a tube insertion port 181 is radially formed in the lower partition 180, an opening 182 through which the tube 140 passes for the flow of the heat medium is formed at a center of the lower partition 180, and an edge portion of the lower partition 180 is provided to be in contact with the inner side surface of the outer jacket 110.

The lower tube sheet 190 seals the lower part of the outer jacket 110 and has a plurality of tube insertion ports 191 and 192 into which the lower end portions of the plurality of tubes 140 are inserted.

Referring to FIGS. 9 and 10, the tubular heat exchanger 100 of the present invention integrally includes a sensible heat exchange part 100*a* in which heat exchange is performed between combustion sensible heat generated in the combustion chamber 120 and a heat medium, and a latent heat exchange part 100*b* in which heat exchange is performed between latent heat of the combustion gas, which passes through the sensible heat exchange part 100*a*, and the heat medium.

The combustion gas generated in the combustion chamber 120 flows in a downward direction along an inner space of the tube 140.

As shown by an arrow in FIG. 10, a heat medium introduced into a first space S1 in the outer jacket 110 through the heat medium introduction port 111 passes through the opening 182 formed in the lower partition 180 to flow to a center of a second space S2 which is provided on the opening 182 via a space between the plurality of tubes 140. The heat medium which flows outwardly in the second space S2 passes through a space G between the middle partition 170 and the outer jacket 110 to flow to a third space S3 which is provided thereon. The heat medium which flows inwardly in the third space S3 is discharged through the heat medium discharge port 112 via a fourth space S4 provided between the combustion chamber body 121 and the outer jacket 110 after passing through the opening 162 formed at a center of the upper partition 160.

As described above, since a flowing direction of the heat medium is alternatively changed inwardly and outwardly in a radial direction, a flowing path of the heat medium may be elongated and heat exchange efficiency may be improved, and since a flowing speed of the heat medium is increased, a boiling situation due to partial overheating which may be caused when the heat medium is congested may be prevented.

Hereinafter, a configuration and an action of the turbulator 150 will be described with reference to FIG. 11.

The turbulator 150 may include a flat part 151 configured to divide the inner space of the tube 140 into two portions and disposed in a longitudinal direction of the tube 140, and a first guide portion 152 and a second guide portion 153 spaced apart from both side surfaces of the flat part 151 along a longitudinal direction and formed to alternatively protrude to be inclined.

The first guide portion 152 is disposed on one side surface of the flat part 151 to be inclined to one side, and the second guide portion 153 is disposed on the other side surface of the flat part 151 to be inclined to the other side. Accordingly, each of the heat media introduced into the first guide portion 152 and the second guide portion 153 is sequentially transferred to the second guide portion 153 and the first guide portion 152 disposed adjacent to an opposite side of the flat part (151) to alternatively flow through both spaces of the flat part 151.

A heat medium introduction end of the first guide portion 152 is connected to one side end of the flat part 151 through a first connection portion 152*a*, and a first communication port 152*b* in which fluid communication is performed through both spaces of the flat part 151 is provided between the one side end of the flat part 151, the first connection portion 152*a*, and the first guide portion 152.

A heat medium introduction end of the second guide portion 153 is connected to the other side end of the flat part 151 through a second connection portion 153*a*, and a second communication port 153*b* in which fluid communication is performed through both spaces of the flat part 151 is provided between the other side end of the flat part 151, the second connection portion 153*a*, and the second guide portion 153.

The first guide portion 152 and the second guide portion 153 may include parts of the flat part 151 cut to be bent to both sides of the flat part 151, and fluid communication may be performed through both spaces of the flat part 151 through a cut part of the flat part 151.

Further, welding parts 154 and 155 may be formed to protrude from the flat part 151 to be in contact with an inner side surface of the tube 140, and thus the welding parts 154 and 155 and the inner side surface of the tube 140 may be configured to be welding-coupled to each other. Accordingly, the number and areas of the welding parts between the turbulator 150 and the tube 140 may be reduced.

According to a configuration of the above-described turbulator 150, as shown by an arrow in FIG. 11B, since a flowing direction of the combustion gas is continuously changed from one side to the other side in the inner space of the tube 140 by the first guide portion 152 and the second guide portion 153, and thus turbulence flow is expedited, heat exchange efficiency between the combustion gas and the heat medium may be improved.

Meanwhile, a temperature of the combustion gradually decreases due to heat exchange between the combustion and the heat medium in a process in which the combustion gas sequentially passes through the sensible heat exchange part 100*a* and the latent heat exchange part 100*b*. Accordingly, the temperature of the combustion gas increases and thus the volume of the combustion gas increases in the sensible heat exchange part 100*a* into which the combustion gas is introduced, and the temperature of the combustion gas decreases, and thus volume of the combustion gas decreases in the latent heat exchange part 100*b* from which the combustion gas is discharged.

Accordingly, in order to improve the heat exchange efficiency, it is preferable to reduce a flow resistance of the combustion gas by forming an area of a path of the combustion gas which passes through the sensible heat exchange part 100*a* to be large, and forming the area of the path of the combustion gas in the latent heat exchange part 100*b* to be relatively small.

To this end, the turbulator 150 integrally includes an upper turbulator 150*a* provided at a side into which the combustion gas is introduced, and a lower turbulator 150*b* provided at a side from which the combustion gas is discharged, and the lower turbulator 150*b* may be formed to have an occupying area in the tube 140 greater than that of the upper turbulator 150*a* so that an area of a path between the lower turbulator 150*b* and the inner side surface of the tube 140 may be formed to be smaller than an area of a path between the upper turbulator 150*a* and the inner side surface of the tube 140.

As an embodiment, as shown in FIG. 11, an interval L2 in which the plurality of first guide portions 152 and the plurality of second guide portions 153 formed in the lower turbulator 150*b* are vertically spaced apart from each other may be disposed at a relatively denser interval than an interval L1 in which the plurality of first guide portions 152 and the plurality of second guide portions 153 formed in the upper turbulator 150*a* are vertically spaced apart from each other.

In this case, in the interval in which the plurality of first guide portions 152 and the plurality of second guide portions 153 formed in the turbulator 150 are vertically spaced apart from each other, an interval which becomes further spaced apart from the side into which the combustion gas is introduced to the side from which the combustion gas is discharged may be formed to be gradually narrower.

In another embodiment, as shown in FIG. 12, a plurality of protrusions 141 may be formed on the inner side surface of the tube 140 located at the side from which the combustion gas is discharged to reduce an area of a path at a discharging side of the combustion gas.

Referring to FIG. 13, a supporter 142 (142*a*, 142*b*, and 142*c*) configured to support water-pressure of the heat medium may be additionally provided in the tube 140.

The supporter 142 may include a straight support part 142*a* having both ends fixed to the inner side surface of the tube 140 as shown in FIG. 13A, and a support part 142*b* having both ends bent to be fixed to the inner side surface of the tube 140 as shown in FIGS. 13B and 13C.

In the case of a structure shown in FIGS. 13A and 13B, one side ends of the support parts 142*a* and 142*b* are welded to a base material on which the tube 140 is formed when manufacturing the tube 140, both end portions of the base material are welded to the other side ends of the support parts 142*a* and 142*b* after rolling and processing the base material in a shape of the tube 140, and the turbulator 150 is insertion-coupled to each of both sides of the support parts 142*a* and 142*b*.

In the case of a structure shown in FIG. 13C, when manufacturing the tube 140, the support part 142*b* and the turbulator 150 may be coupled, and then a coupled body of the support part 142*b* and the turbulator 150 may be pressed in the tube 140 to be coupled.

In another embodiment, as shown in FIG. 13D, the supporter 142 may include an embossing portion 142*c* formed on each of both corresponding side surfaces of the tube 140 to protrude toward the inside of the tube 140. According to the above configuration, when high water-pressure is applied to the outside of the tube 140, an embossing portion 145 formed at the corresponding location may be in contact with the tube 140 to prevent deformation of the tube 140.

As described above, since the supporter 142 is coupled to the inside of the tube 140, deformation of the tube 140 may be prevented even when the water-pressure of the heat medium tube 140 is strongly applied to the outer surface of tube 140. Accordingly, the tube 140 coupled to the supporter 142 may be applied to combustion apparatuses for various usage in addition to a boiler or a water heater.

As described above, the present invention is not limited to the above-described particular embodiments. It should be appreciated by those skilled in the art that changes may be made without departing from the spirit of the present invention claimed in the claims and their equivalents, and the changes are included in the scope of the present invention.

The invention claimed is:

1. A tubular heat exchanger comprising:

an outer jacket (110) through which a heat medium is introduced and discharged;

a combustion chamber (120) coupled to the inside of the outer jacket (110) so that a heat medium passage is formed between the combustion chamber (120) and the outer jacket (110), and configured to perform combustion of a burner;

a plurality of tubes (140) formed in a flat shape for allowing combustion gas, which is generated in the combustion chamber (120), to flow along the inside of the plurality of tubes (140) and exchange heat with the heat medium; and a turbulator (150) coupled to the inside of the tubes (140) to induce generation of turbulence in a flow of the combustion gas, wherein the tubular heat exchanger characterized by further comprising:

the turbulator (150) includes an upper turbulator (150*a*) provided at a side into which the combustion gas is introduced, and a lower turbulator (150*b*) provided at a side from which the combustion gas is discharged; and an area of a path between the lower turbulator (150*b*) and an inner side surface of the tube (140) is formed to be smaller than an area of a path between the upper turbulator (150*a*) and the inner side surface of the tube (140) for corresponding to changes in temperature and volume of the combustion gas passing through the tubes (140).

2. The tubular heat exchanger of claim 1, wherein the plurality of tubes (140) are installed in a vertical direction so that the combustion gas generated in the combustion chamber (120) flows in a downward direction and are spaced apart in a circumferential direction and radially disposed.

3. The tubular heat exchanger of claim 2, wherein a plurality of tubes (140) are additionally disposed at a center between the plurality of tubes (140) which are radially disposed.

4. The tubular heat exchanger of claim 1, wherein multiple-stage partitions (160, 170, and 180) configured to guide a flow of the heat medium are provided in the outer jacket (110) to be vertically spaced apart from each other so that a flowing direction of the heat medium is alternatively changed between the inside and the outside of a circumferential direction.

5. The tubular heat exchanger of claim 4, wherein the plurality of tubes (140) are inserted into the multiple-stage partitions (160, 170, and 180) to be supported.

6. The tubular heat exchanger of claim 4, wherein the multiple-stage partitions (160, 170, and 180) include an upper partition (160), a middle partition (170), and a lower partition (180) each having a plate shape, wherein:

each of the upper partition (160) and the lower partition (180) has an opening for the flow of the heat medium at a center thereof, and an edge portion provided to be in contact with an inner side surface of the outer jacket (110); and the middle partition (170) is formed in a shape of which a center is blocked and has an edge portion provided to be spaced apart from the inner side surface of the outer jacket (110) so that the heat medium flows therebetween.

7. The tubular heat exchanger of claim 4, wherein:

an upper tube sheet (130) into which upper end portions of the plurality of tubes (140) are inserted is coupled to a lower end of the combustion chamber (120); and a lower tube sheet (190) into which lower end portions of the plurality of tubes (140) are inserted is coupled to a lower end of the outer jacket (110).

8. The tubular heat exchanger of claim 1, wherein the turbulator (150) includes a flat part (151) configured to divide an inner space of the tube (140) into two portions and disposed in a longitudinal direction of the tube (140), and a plurality of first guide portions (152) and second guide portions (153) spaced apart from both side surfaces of the flat part (151) along a longitudinal direction and formed to alternatively protrude to be inclined.

9. The tubular heat exchanger of claim 8, wherein:

an interval (L2) in which the plurality of first guide portions (152) and the plurality of second guide portions (153) formed in the lower turbulator (150*b*) are vertically spaced apart from each other is disposed at a relatively denser interval than an interval (L1) in which the plurality of first guide portions (152) and the plurality of second guide portions (153) formed in the upper turbulator (150*a*) are vertically spaced apart from each other.

10. The tubular heat exchanger of claim 8, wherein:

the first guide portion (152) is disposed on one side surface of the flat part (151) to be inclined to one side;

the second guide portion (153) is disposed on the other side surface of the flat part (151) to be inclined to the other side; and each of the heat media introduced into the first guide portion (152) and the second guide portion (153) is sequentially transferred to the second guide portion (153) and the first guide portion (152) disposed adjacent to an opposite side of the flat part (151) to alternatively flow through both spaces of the flat part (151).

11. The tubular heat exchanger of claim 10, wherein:

a heat medium introduction end of the first guide portion (152) is connected to one side end of the flat part (151) through a first connection portion (152*a*), and a first communication port (152*b*) in which fluid communication is performed through both spaces of the flat part (151) is provided between the one side end of the flat part (151), the first connection portion (152*a*), and the first guide portion (152); and a heat medium introduction end of the second guide portion (153) is connected to the other side end of the flat part (151) through a second connection portion (153*a*), and a second communication port (153*b*) in which fluid communication is performed through both spaces of the flat part (151) is provided between the other side end of the flat part (151), the second connection portion (153*a*), and the second guide portion (153).

12. The tubular heat exchanger of claim 8, wherein:

the first guide portion (152) and the second guide portion (153) include parts of the flat part (151) cut to be bent to both sides of the flat part (151); and fluid communication is performed through both spaces of the flat part (151) through a cut part of each of the first guide portion (152) and the second guide portion (153).

13. The tubular heat exchanger of claim 1, wherein the lower turbulator (150*b*) is formed to have an occupying area in the tube (140) greater than that of the upper turbulator (150*a*).

14. The tubular heat exchanger of claim 1, wherein a plurality of protrusions (141) are formed on the inner side surface of the tube (140) located at the side from which the combustion gas is discharged.

15. The tubular heat exchanger of claim 1, wherein a supporter (142) configured to support water-pressure is additionally provided in the tube (140).

16. The tubular heat exchanger of claim 15, wherein the supporter (142) includes a support part of which both ends are fixed to an inner side surface of the tube (140).

17. The tubular heat exchanger of claim 15, wherein the supporter (142) includes an embossing portion formed on each of both corresponding side surfaces of the tube (140) to protrude toward the inside of the tube (140).

18. The tubular heat exchanger of claim 1, wherein the outer jacket (110) is formed in a cylindrical shape.

* * * * *